US005635441A

United States Patent [19]

Sam et al.

[11] Patent Number: 5,635,441

[45] Date of Patent: Jun. 3, 1997

[54] PRINTING PAPER

[75] Inventors: Huy Sam; Yoshinori Nakamura; Atsushi Ito, all of Miyagi; Hidemi Tomita, Tokyo; Miyuki Kuromiya, Kanagawa, all of Japan

[73] Assignee: Sony Corporation, Tokyo, Japan

[21] Appl. No.: 522,784

[22] Filed: Sep. 1, 1995

[30] Foreign Application Priority Data

Sep. 3, 1994 [JP] Japan ..... 6-234362

[51] Int. Cl.[6] ..... B41M 5/035; B41M 5/38

[52] U.S. Cl. ..... 503/227; 428/195; 428/423.1; 428/500; 428/913; 428/914

[58] Field of Search ..... 8/471; 428/195, 428/500, 480, 535, 423.1, 913, 914; 503/227

[56] References Cited

U.S. PATENT DOCUMENTS

| | | | |
|---|---|---|---|
| 4,505,975 | 3/1985 | Majima | 428/336 |
| 4,721,703 | 1/1988 | Kobayashi et al. | 503/227 |
| 4,731,355 | 3/1988 | Iwasaki et al. | 503/227 |
| 4,746,646 | 5/1988 | Nakanishi et al. | 503/227 |
| 5,187,144 | 2/1993 | Shinohara et al. | 503/227 |
| 5,294,484 | 3/1994 | Kobayashi et al. | 428/511 |
| 5,324,705 | 6/1994 | Ito | 503/227 |
| 5,332,712 | 7/1994 | Shinohara et al. | 503/227 |

FOREIGN PATENT DOCUMENTS

| | | | |
|---|---|---|---|
| 0 580 123 | 1/1994 | European Pat. Off. | 503/227 |
| A-93-007 384 | 1/1991 | Japan | 503/227 |

OTHER PUBLICATIONS

Derwent Publications Ltd., Database WPI, Section Ch, Week 9108, Class A89, AN 91–055613.

*Primary Examiner*—Bruce H. Hess

*Attorney, Agent, or Firm*—Hill, Steadman & Simpson

[57] ABSTRACT

Disclosed is Printing paper which incorporates a sheet substrate and a dye-receiving layer wherein the dye-receiving layer contains a vinylphenolic resin and a dyeable resin or contains a polymer of a vinylphenolic resin, a butyral resin and a poly-functional isocyanate. The printing paper is used in thermal sublimation transfer recording and gives an image with improved storing characteristics in terms of the light resistance, dark fading resistance, sebum resistance, plasticizer resistance, etc.

4 Claims, 1 Drawing Sheet

PRINTING PAPER

FIELD OF THE INVENTION

The present invention relates to printing paper for thermal sublimation transfer recording. More precisely, it relates to printing paper containing, in its dye-receiving layer, a vinylphenolic resin or a polymer of a vinylphenolic resin, a butyral resin and an isocyanate compound, by which the storability including the sebum resistance, the plasticizer resistance, the light resistance, etc. of the image to be formed on its dye-receiving layer is improved.

BACKGROUND OF THE INVENTION

A thermal sublimation transfer recording process is known, in which printing paper having a dye-receiving layer is attached to an ink ribbon having an ink layer comprising a subliming or hot-diffusing dye and the ink layer of the ink ribbon is heated with a thermal head or the like in accordance with image information whereby the dye is transferred from the ink layer to the dye-receiving layer of the printing paper to form an image on the paper. According to this process, it is possible to form full-color images with continuous gradations. Therefore, the process has been considered useful for forming hard copies from video images.

FIG. 1 is a cross-sectional view of an ordinary printing paper 1 which is used for thermal sublimation transfer recording. As shown in this, the printing paper 1 has a laminate structure comprising a sheet substrate 2 and a dye-receiving layer 3. The dye-receiving layer 3 receives the dye that has been transferred from an ink ribbon by thermal transfer recording and keeps the image of the dye. The dye-receiving layer 3 of this type comprises a dyeable resin such as polyesters, cellulose esters, polycarbonates, polyvinyl chlorides, etc.

Recently, printing paper such as that shown in FIG. 1 is required to have the following properties in order that it may be applied to high-speed printers.

(i) It has high dye-fixability and can form a glossy and sharp image having a high density.

(ii) The storage stability of the image formed thereon is good. Precisely, (a) the image has good fingerprint resistance and sebum resistance. Concretely, when the image is contacted with a part of a human body such as hands, fingers, etc., the dye forming the image is neither aggregated nor faded. (b) The image has good plasticizer resistance. Concretely, when the image is contacted with a plastic eraser containing a plasticizer or its wastes, the dye forming the image is neither aggregated nor faded. (c) The image has high light resistance in order that it is neither faded nor discolored when exposed to light. (d) The image has dark fading resistance.

In order to satisfy these requirements, various proposals have been made for the constitution of printing paper. For instance, U.S. Pat. No. 4,731,355 has disclosed the use of a butyral resin as the essential component in the dye-receiving layer of printing paper. U.S. Pat. Nos. 5,187,144 and 5,332,712 have disclosed the use of a polyvinyl acetal resin as the essential component in the dye-receiving layer of printing paper.

However, the conventional printing paper where the dye-receiving layer is made of a dyeable resin such as polyesters, etc. had problems in that the light resistance, the dark fading resistance, the sebum resistance and the plasticizer resistance of the image formed are not sufficient and therefore the storability of the image is poor. Even the printing paper comprising, as the essential component in the dye-receiving layer, a butyral resin or a polyvinyl acetal resin does not still have satisfactory storability, and the improvement in this respect has been desired. In particular, indaniline dyes are useful as cyanine dyes having high transfer sensitivity, but the light resistance of images of such indaniline dyes was insufficient.

In order to solve the problem of the storability of the image formed, a storability-improving agent such as an UV absorbent, an antioxidant, etc. is added to the dye-receiving layer, which, however, does not attain a sufficient result. In order to improve the sebum resistance and the plasticizer resistance of the image formed, a cover film is laminated over the printing paper having an image formed thereon, which, however, is problematic in that it needs the laminating step in addition to the image-forming step in the conventional thermal transfer recording process. In addition, the outward appearance and the thickness of the printing paper laminated with the cover film are often problematic.

SUMMARY OF THE INVENTION

The present invention is to solve the problems in the related art, and its object is to provide printing paper capable of forming thereon an image with good storing characteristics including light resistance, dark fading resistance, sebum resistance, plasticizer resistance, etc. even when the image comprises any desired dye including indaniline dyes.

The present inventors have found that when the dye-receiving layer of printing paper comprises a vinylphenolic resin of particular embodiments or, that is, when the dye-receiving layer comprises a vinylphenolic resin, such as p-vinylphenol polymers, etc., along with a conventional dyeable resin, such as polyesters, etc., or when the dye-receiving layer comprises a crosslinked polymer of vinylphenolic resin, such as p-vinylphenol polymers, etc., a butyral resin and a poly-functional isocyanate, the storing characteristics of the image to be formed on the printing paper can be improved greatly.

Specifically, the present invention provides, as its first aspect, printing paper composed of a sheet substrate and a dye-receiving layer wherein the dye-receiving layer comprises a vinylphenolic resin and a dyeable resin.

The present invention provides, as its second aspect, printing paper composed of a sheet substrate and a dye-receiving layer wherein the dye-receiving layer comprises a polymer of a vinylphenolic resin, a butyral resin and a poly-functional isocyanate compound.

DETAILED DESCRIPTION OF THE INVENTION

Figure 1:
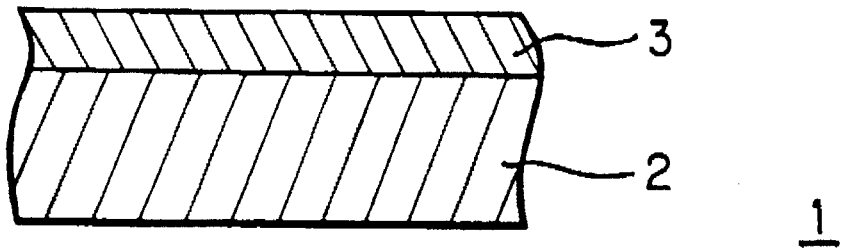
FIG. 1 is a cross-sectional view of ordinary printing paper.
Figure 2:
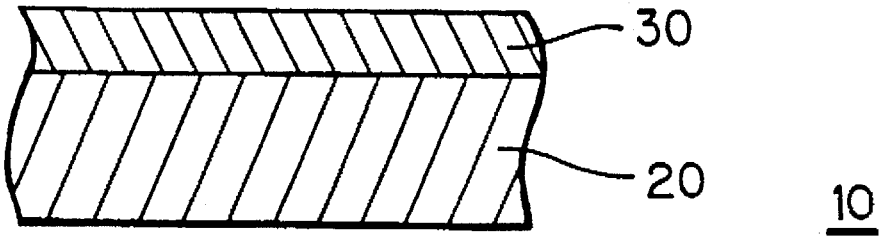
FIG. 2 is a cross-sectional view of the structure of the present invention.

The printing paper 10 of the present invention has a laminate structure basically comprising a sheet substrate and a dye-receiving layer 30, as shown in FIG. 2.

The printing paper 10 of the first aspect of the present invention is the same as that of the second aspect thereof in that the dye-receiving layer 30 comprises as its constitutive component a vinylphenolic resin, but the two are different from each other in that the former further comprises a dyeable resin as in the conventional printing paper.

The vinylphenolic resin as referred to herein includes a homopolymer of vinylphenols such as p-vinylphenol, m-vinylphenol, etc. and a copolymer comprising vinylphenols such as p-vinylphenol, m-vinylphenol, etc. and other comonomers. Either the vinylphenolic homopolymer or copolymer or both of these can be used in the present invention. In view of the industrial availability of the polymers, p-vinylphenol polymers are preferred.

Various monomers can be used as the other comonomers constituting the vinylphenolic copolymers but are preferably halogenated p-vinylphenols, styrene, (meth)acrylic acid, (meth)acrylates, etc. The vinylphenolic resin, comprising any of vinylphenolic homopolymers or copolymers, may contain cyclohexanol units to be formed by reduction of vinylphenols, such as p-cyclohexanol units. However, it is desirable that the content of the vinylphenol units in the vinylphenolic resin is 1% by weight or more.

If the softening point of the vinylphenolic homopolymer or copolymer is too low, such causes blocking or bleeding of the printed paper. However, if it is too high, the sensitivity of the printing paper 10 is lowered. In general, therefore, the polymer preferably has a softening point of from 20° to 120° C. Regarding the molecular weight of the polymer, if the polymer has a too small molecular weight, the dye-receiving layer 30 containing it is brittle; but if it has a too large molecular weight, the sensitivity of the printing paper 10 containing it is often lowered. In general, therefore, the polymer preferably has a molecular weight of from 1000 to 200000.

The proportion of the vinylphenolic resin in the dye-receiving layer 30 is preferably from 0.1 to 99.9% by weight. As containing the vinylphenolic resin, the surface of the dye-receiving layer 30 is covered with the resin. Therefore, even when the proportion of the vinylphenolic resin in the dye-receiving layer 30 is small or 0.1% by weight, the sebum resistance of the image formed on the printing paper 10 can be improved well.

In the first aspect of the present invention, the dye-receiving layer 30 comprises a dyeable resin along with the vinylphenolic resin. The dyeable resin includes cellulose esters, such as cellulose acetate butyrate, cellulose acetate propionate, cellulose acetate, etc., polyesters, polycarbonates, polyvinyl chlorides, etc. These are available as commercial products. For example, usable are CABS51-a01, CABS51-0.1, CAB551-0.2, CABS31-1, CAB500-1, CAB500-5, CAB553-0.4, CAB381-0.1, CAB381-0.5, CAB381-0.5BP, CAB381-2, CAB381-2BP, CAB381-20, CAB381-20BP, CAB171-15S, etc. as cellulose acetate butyrate; CAP482-0.5, CAP482-20, CAP504-0.2, etc. as cellulose acetate propionate; CA-394-60S, CA-398-3, CA-398-6, CA-398-10, CA-398-30, etc. as cellulose acetate. These are all commercial products of Eastman Kodak Co. As saturated polyester resins, usable are Bailon 200, Bailon 290, Bailon 600 (all products of Toyobo Co.); UE3600, XA60098, XA7026 (all products of Unichika Co.); TP220, TP235 (both products of Nippon Synthetic Chemical Co.), etc.

The dye-receiving layer 30 of the printing paper 10 of the first aspect of the present invention may optionally contain compounds that further improve the light resistance, the dark fading resistance, the dyeability, etc. of the paper, in addition to the above-mentioned vinylphenolic resin and dyeable resin. Such compounds are preferably compatible with the dyeable resin, including, for example, ester compounds and urethane compounds such as those mentioned below.

Many ester compounds which are generally used as plasticizers can be used, and those having a boiling point of not higher than 180% at normal pressure are preferred. For example, usable are esters of aromatic polybasic acids, such as phthalic acid, trimellitic acid, etc., aliphatic polybasic acids, such as succinic acid, etc., or alicyclic polybasic acids and aliphatic alcohols, alicyclic alcohols or phenols. In addition, also usable are polyphenol esters, polyalcohol esters, phosphates, carbonates, other various monoesters, etc.

More concretely the polyphenol esters include catechol diacetate, catechol dipropionate, catechol dibutyrate, catechol dibenzoate, catechol di-o-toluate, catechol di-p-toluate, catechol dicrotonate, catechol butyrate benzoate, resorcinol diacetate, resorcinol dibutyrate, resorcinol acetate benzoate, resorcinol dibenzoate, hydroquinone diacetate, hydroquinone benzoate, hydroquinone dicaproate, pyrogallol triacetate, pyrogallol tribenzoate, bisphenol A butyrate, bisphenol A benzoate, 4,4'-methylenebis-(2,6-di-isopropyl) diacetate, 4,4'-thiobisphenol butyrate, etc.

The polyalcohol esters include ethylene glycol dibenzoate, diethylene glycol di-o-toluate, glycerin tribenzoate, glycerin triacetate, pentaerythritol tetrapropionate, pentaerythritol tetrabenzoate, hydrogenated bisphenol A diacetate, hydrogenated bisphenol A dibenzoate, dipentaerythritol benzoate, etc.

The esters of aromatic polybasic acids include trimellitates such as trimethyl trimellitate, tribenzyl trimellitate, trioctyl trimellitate, tetraethyl pyromellitate, tetracyclohexyl pyromellitate, etc.; phthalates such as dimethyl phthalate, diethyl phthalate, dibutyl phthalate, dioctyl phthatate, diphenyl phthalate, dicresyl phthalate, phenylethylene phthalate, dibenzoyl phthalate, diphenoxyethyl phthalate, dicyclohexyl phthalate, dimethyl isophthalate, diphenyl isophthalate, dibenzyl isophthalate, diethyl terephthalate, etc.

The esters of alicyclic carboxylic acids include dioctyl tetrahydrophthalate, diphenyl tetrahydrophthalate, dibenzyl tetrahydrophthalate, etc.

The esters of aliphatic polybasic acids include diphenyl succinate, dimethyl succinate, dibenzyl succinate, dibenzyl adipate, dimethyl adipate, diethyl azelate, dibenzyl sebacate, diphenyl sebacate, diethyl maleate, dibenzyl maleate, diphenyl maleate, dibenzyl fumarate, diphenyl fumarate, tribenzyl citrate, acetyltribenzyl citrate, diethyl itaconate, etc.

The phosphates include triphenyl phosphate, tribenzyl phosphate, cresyldiphenyl phosphate, trihexyl phosphate, tricyclohexyl phosphate, tetrakis(2,4-di-tert-butylphenyl)-4, 4'-biphenyl phosphate, etc.

The carbonates include diphenyl carbonate, di-o-methylphenyl carbonate, di-p-methylphenyl carbonate, dinaphthyl carbonate, di-o-phenylphenyl carbonate, di-p-phenylphenyl carbonate, dioctyl carbonate, etc.

The other monoesters include 2,2,4-trimethyl-pentanediol monophthalate, phenyl monophthalate, methyl stearate, phenyl laurate, benzyl salicylate, propyl p-hyroxybenzoate, benzyl methoxybenzoate, butyl phenoxybenzoate, etc.

Of these ester compounds, phthalates are especially preferred in view of their dyeability and light fastness.

The urethane compounds include aliphatic urethane compounds such as 1,6-hexamethylene-dibutylurethane, 1,6-hexamethylene-dioctylurethane, etc.; and aromatic urethane compounds such as m-xylene-dibutylurethane, p-xylene-dioctylurethane, 2,4-toluene-dihexylurethane, 2,6-toluene-dibenzylurethane, 4,4'-diphenylmethane-dibutylurethane, 4,4'-diphenylmethane-dioctylurethane, ethylene-diphenylurethane, 1,4-tetramethylene-diphenylurethane, 1,6-hexamethylene-di-p-methylphenylurethane, p-xylene-di-p-chlorophenylurethane, o-xylene-dibutylurethane, m-xylene-dicyclohexylurethane, etc. Of these urethane compounds, aromatic urethane compounds are preferred in view of their dyeability.

The proportion of the above-mentioned ester compound or urethane compound in the dye-receiving layer 30 is, though depending on the monomer composition to be used for forming the dye-receiving layer 30, etc., generally preferably from 5 to 40% by weight, especially preferably from 10 to 20% by weight.

To incorporate these ester compounds and urethane compounds into the dye-receiving layer 30, these may be mixed with a solution containing the dyeable resin or a hot melt of the resin.

Where these ester compounds and urethane compounds are to be in the dye-receiving layer 30 in the printing paper 10 of the first aspect of the present invention, monomers or oligomers of such ester compounds and urethane compounds may be mixed with the solution or the hot melt. Such oligomers include, for example, oligo-polyesters of dibasic acids and glycol, cyclic oligo-esters of cyclic esters, low-molecular polymers of vinyl esters, oligo-urethanes (glycol-rich) to be obtained from glycol and diisocyanates, etc. More concretely, usable are polytetraadipates, polyhexamethylene succinates, poly-m-xylene glycol sebacates, polycaprolactones, polyvinyl benzoates, oligo-urethanes obtained by reacting 2 mols of hexamethylene diisocyanate and 3 mols of tetramethylene glycol, oligo-urethanes obtained by reacting 2 mols of m-xylene diisocyanate and 3 mols of octamethylene glycol, etc. It is desirable that these oligomers have a degree of polymerization of 5 or less.

If desired, the dye-receiving layer 30 in the printing paper 10 of the first aspect of the present invention may contain other resins. For instance, it may contain resins with ester bonds (polyacrylate resins, polyvinyl acetate resins, styrene acrylate resins, vinyltoluene acrylate resins, etc.), polyurethane resins (ether-type polyurethanes or ester-type polyurethanes to be derived from hydroxyl-terminated polyethers or polyesters, etc.), polyamide resins (polyamides to be obtained from branched diamines and dimeric acids, etc., such as nylons, etc.), urea resins (reaction products of diamino acids and diisocyanates, reaction products of ureas and aldehydes, etc.), polycaprolactone resins, polystyrenic resins, polyacrylonitriles and their copolymers, etc.

If desired, the dye-receiving layer 30 in the printing paper 10 of the first aspect of the present invention may contain various additives. For instance, it may contain fluorescent whitening agents (fluorescent dyes) and white pigments, by which the degree of whiteness of the dye receiving layer 30 is improved to thereby increase the degree of sharpness of the transferred image, the surface of the image is made writable and the image is prevented from being re-transferred. As the fluorescent whitening agents, usable are commercial products such as Ubitex OB produced by Ciba-Geigy Co., etc. As the white pigments, usable are titanium oxide, zinc oxide, kaolin, clay, calcium carbonate, fine powdery silica, etc. These can be added to the layer singly or as combinations of two or more.

The dye-receiving layer 30 may further contain one or more of ultraviolet absorbents, light stabilizers, antioxidants, surface-improving agents, etc.

The dye-receiving layer 30 may also contain releasing agents, by which the releasability of the printed paper from the ink ribbon after thermal transfer is improved. The releasing agents include solid waxes such as polyethylene wax, amide wax, Teflon powder, etc.; fluorine surfactants, phosphate surfactants, silicone oils, high melting point silicone waxes, etc. Of these, silicone oils are preferred in view of their releasability and durability.

The silicone oils may be either oily or reacted (cured) ones. The reacted (cured) silicone oils include cured reaction products of alcohol-modified silicone oils and isocyanates, cured reaction products of epoxy-modified silicone oils (epoxy-polyether-modified silicone oils) and carboxy-modified silicone oils (carboxy-polyether-modified silicone oils), cured reaction products of amino-modified silicone oils (amino-polyether-modified silicone oils) and carboxy-modified silicone oils (carboxy-polyether-modified silicone oils), etc.

The dye-receiving layer 30 may also contain antistatic agents, by which the printing paper 10 is prevented from being charged with static electricity while it is processed or is run in a printer. Various surfactants are usable as the antistatic agents, including cationic surfactants (quaternary ammonium salts, polyamines, etc.), anionic surfactants (alkylbenzene sulfonates, sodium alkylsulfates, etc.), ampholytic surfactants, nonionic surfactants, etc. Such antistatic agents may be either incorporated into the dye-receiving layer 30 or applied to the surface of the layer by coating.

To form the dye-receiving layer 30, the components constituting the dye-receiving layer 30 are uniformly mixed optionally along with a solvent to prepare a coating composition, and the composition is applied to a sheet substrate, or hot melts of the components are applied thereto, and thereafter the thus-coated substrate is cured.

The second aspect of the present invention is characterized in that the dye-receiving layer 30 in the printing paper 10 comprises a polymer of a vinylphenolic resin, a butyral resin and a poly-functional isocyanate compound. The polymer is obtained due to the high reactivity between the vinylphenolic resin and the poly-functional isocyanate, in which the vinylphenolic resin and the butyral resin are crosslinked and polymerized with the poly-functional isocyanate compound. Containing the polymer of this type as the essential constitutive component, the dye-receiving layer 30 has much improved oil resistance and therefore the printing paper 10 has much improved sebum resistance and plasticizer resistance.

As the vinylphenolic resin, preferred is a homopolymer of p-vinylphenol or m-vinylphenol. Also preferred is a copolymer of p-vinylphenol or m-vinylphenol and other comonomers. If desired, the homopolymer and the copolymer may be combined for use in the present invention. In view of the industrial availability, p-vinylphenol polymers are preferred.

Various monomers can be used as the other comonomers constituting the vinylphenolic copolymers but are preferably halogenated p-vinylphenols, styrene, (meth) acrylic acid, (meth)acrylates, etc. The vinylphenolic homopolymer and copolymer may contain cyclohexanol units to be formed by reduction of vinylphenols such as p-cyclohexanol units. However, it is desirable that the content of the vinylphenol units in the vinylphenol polymer is 1% by weight or more.

If the softening point of the vinylphenolic resin is too low, such causes blocking or bleeding of the printed paper. However, if it is too high, the sensitivity of the printing paper 10 is lowered. In general, therefore, the resin preferably has a softening point of from 20° to 120° C. Regarding the molecular weight of the resin, if the resin has a too small molecular weight, the dye-receiving layer 30 containing it is brittle; but if it has a too large molecular weight, the sensitivity of the printing paper 10 containing it is often lowered. In general, therefore, the resin preferably has a molecular weight of from 1000 to 500000.

It is desirable that the butyral resin has a degree of butyralation of 50 mol % or more, preferably from 55 to 75 mol %. The butyral resin may be partially acetylated, as in the following formula (1):

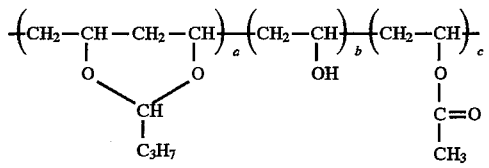

(1)

In this case, the degree of acetylation is preferably 3% or less. The molecular weight (weight average molecular weight Mw) of the butyral resin is preferably from 10000 to 500000 or so in view of the solubility and the processability the resin.

It is desirable that the poly-functional isocyanate compound is a non-yellowed one. For instance, preferred are aliphatic polyisocyanates such as hexamethylene diisocyanate (HDI), biuret, etc.; and aromatic polyisocyanates such as toluene diisocyanate (TDI), xylene diisocyanate (XDI), etc. These may be used singly or as combinations of two or more.

The proportions of the vinylphenolic resin, the butyral resin and the poly-functional isocyanate compound constituting the polymer to be used in the second aspect of the present invention are preferably such that the vinylphenolic resin is from 1 to 100 parts by weight relative to 100 parts by weight of the butyral resin. If the ratio of the vinylphenolic resin to the butyral resin is too large, the dyeing sensitivity of the dye-receiving layer 30 is lowered. However, on the contrary, if it is too small, the storability of the printing paper 10 is lowered and the effect of the present invention cannot be attained. Therefore, such is unfavorable. It is desirable that the poly-isocyanate compound is from 1 to 50 parts by weight relative to 100 parts by weight of the sum of the vinylphenolic resin and the butyral resin. If proportion of the poly-isocyanate compound is too large, the pot life of the coating composition for the dye-receiving layer 30 is shortened. If, on the contrary, it is too small, the crosslinked density of the polymer is lowered and the effect of the present invention cannot be attained. Therefore, such is unfavorable.

To form the dye-receiving layer 30 comprising the above-mentioned polymer of the vinylphenolic resin, the butyral resin and the poly-functional isocyanate compound, the vinylphenolic resin, the butyral resin and the poly-functional isocyanate compound are uniformly mixed optionally along with a solvent to prepare a coating composition, and the composition is applied to a sheet substrate, or hot melts of the components are applied thereto, and thereafter the thus-coated substrate is cured. The dye-receiving layer 30 may contain various ester compounds and urethane compounds in order to further improve its light resistance, dark fading resistance and dyeability, like the dye-receiving layer 30 in the first aspect of the present invention.

The dye-receiving layer 30 may also contain various additives such as fluorescent whitening agents, white pigments, ultraviolet absorbents, light stabilizers, antioxidants, surface-improving agents, releasing agents, antistatic agents, etc., like the dye-receiving layer 30 in the first aspect of the present invention.

In the first and second aspects of the present invention, the sheet substrate may be any of paper such as high-quality paper, coated paper, etc., various plastic sheets, composite sheets comprising them, etc.

The back surface of the sheet substrate opposite to the surface coated with the dye-receiving layer 30 may be coated with a back coat layer comprising an acrylic resin, a silicone resin, etc., by which the runability of the printing paper 10 in a printer is improved and the feeding of plural sheets of printing paper 10 at a time into a printer is prevented.

The method for forming an image on the printing paper 10 of the present invention is not specifically defined. For example, the image formation on the printing paper 10 may be conducted by thermal sublimation transfer recording, using a commercial video printer or the like and a thermal sublimation transfer recording ribbon.

The printing paper 10 of the first aspect of the present invention comprises a dye-receiving layer 30 containing a dyeable resin and a vinylphenolic resin, and the printing paper 10 of the second aspect of the present invention comprises a dye-receiving layer 30 containing a polymer of a vinylphenolic resin and a butyral resin crosslinked with a poly-functional isocyanate compound. Therefore, the image formed on the dye-receiving layer 30 in the both aspects has extremely improved storing characteristics such as light resistance, dark fading resistance, sebum resistance, plasticizer resistance, etc.

The light resistance and the dark fading resistance of the image formed is due to the vinylphenolic resin acting as an antioxidant for the dye image formed in the dye-receiving layer 30. As a result the dyes constituting the image are prevented from being decomposed.

Next, the present invention is described concretely by means of the following examples.

EXAMPLES 1 to 19, Comparative Examples 1 to 6:

A synthetic paper (EPG-150, produced by Oji Petro-Chemical Co.) having a thickness of 150 μm was prepared as a sheet substrate, and this was coated with a coating composition for a dye-receiving layer 30 comprising the components indicated in Tables 1 to 3 below and then cured at 50° C. for 48 hours. Thus, various types of printing paper 10 were produced.

TABLE 1

| | Examples (parts by weight) | | | | | | | | |
|---|---|---|---|---|---|---|---|---|---|
| | 1 | 2 | 3 | 4 | 5 | 6 | 7 | 8 | 9 |
| Cellulose ester (*1) | 20 | 20 | 20 | 20 | 20 | 20 | 20 | 20 | 20 |
| Cellulose ester (*2) | — | — | — | — | — | — | — | — | — |
| Polyester (*3) | — | — | — | — | — | — | — | — | — |
| P-vinylphenol polymer (*4) | 1 | 10 | — | — | 5 | — | — | — | — |
| P-vinylphenol polymer (*5) | — | — | 5 | — | — | — | — | — | — |
| P-vinylphenol polymer (*6) | — | — | — | 5 | — | — | — | — | — |
| P-vinylphenol polymer (*7) | — | — | — | — | 5 | 5 | 10 | 20 | — |
| P-vinylphenol polymer (*8) | — | — | — | — | — | — | — | — | 5 |
| Antioxidant (*9) | — | — | — | — | — | — | — | — | — |
| Antioxidant (*10) | — | — | — | — | — | — | — | — | — |
| Antioxidant (*11) | — | — | — | — | — | — | — | — | — |

With regard to Table 1, the following will be noted:
(*1) Cellulose acetate butyrate: CAB500-5 produced by Kodak Co.
(*2) Cellulose acetate propionate: CAP482.05 produced by Kodak Co.
(*3) Bailon #200 produced by Toyobo Co.
(*4) P-vinylphenol homopolymer (molecular weight 1600 to 2400; softening point 143° C.; Marukalinker M produced by Maruzen Petrochemical Co.)
(*5) Reduced p-vinylphenol homopolymer (molecular weight 4000 to 6000; softening point 190° C.; Marukalinker PHM-C produced by Maruzen Petrochemical Co.)
(*6) Copolymer of p-vinylphenol and styrene (PVP/ST = about 15/85; molecular weight 7000 to 10000; softening point 120° C.; Marukalinker CST15 produced by Maruzen Petrochemical Co.)
(*7) Copolymer of p-vinylphenol and butyl acrylate (PVP/PA = about 30/70 to 60/40; molecular weight 10000 to 30000; softening point 30 to 100° C.; Marukalinker CBA produced by Maruzen Petrochemical Co.)
(*8) Copolymer of p-vinylphenol and methyl methacrylate (pVP/Mm = about 1/1; molecular weight 8000 to 12000; softening point 180° C.; Marukalinker Cmm produced by Maruzen Petrochemical Co.)
(*9) Sumilizer TM-4048 produced by Sumitomo Chemical Co.
(*10) Viosorb 80 produced by Kyodo Chemicals Co.
(*11) Viosorb 130 produced by Kyodo Chemicals Co.

TABLE 2

| | Examples (parts by weight) | | | | | | | | | |
|---|---|---|---|---|---|---|---|---|---|---|
| | 10 | 11 | 12 | 13 | 14 | 15 | 16 | 17 | 18 | 19 |
| Cellulose ester (*1) | — | — | — | — | — | — | — | — | — | — |
| Cellulose ester (*2) | 20 | 20 | 20 | 20 | 20 | — | — | — | — | — |
| Polyester (*3) | — | — | — | — | — | 20 | 20 | 20 | 20 | 20 |
| P-vinylphenol polymer (*4) | 5 | — | — | — | — | 5 | — | — | — | — |
| P-vinylphenol polymer (*5) | — | 5 | — | — | — | — | 5 | — | — | — |
| P-vinylphenol polymer (*6) | — | — | 5 | — | — | — | — | 5 | — | — |
| P-vinylphenol polymer (*7) | — | — | — | 5 | — | — | — | — | 5 | — |
| P-vinylphenol polymer (*8) | — | — | — | — | 5 | — | — | — | — | 5 |
| Antioxidant (*9) | — | — | — | — | — | — | — | — | — | — |
| Antioxidant (*10) | — | — | — | — | — | — | — | — | — | — |
| Antioxidant (*11) | — | — | — | — | — | — | — | — | — | — |

TABLE 3

| | Comparative Examples (parts by weight) | | | | | |
|---|---|---|---|---|---|---|
| | 1 | 2 | 3 | 4 | 5 | 6 |
| Cellulose ester (*1) | | | | | | |
| Cellulose ester (*2) | | — | — | — | — | — |
| Polyester (*3) | — | — | — | — | — | — |
| P-vinylphenol polymer (*4) | 1 | 10 | — | — | 5 | — |
| P-vinylphenol polymer (*5) | — | — | 5 | — | — | — |
| P-vinylphenol polymer (*6) | — | — | — | 5 | — | — |
| P-vinylphenol polymer (*7) | — | — | — | — | 5 | 5 |
| P-vinylphenol polymer (*8) | — | — | — | — | — | — |
| Antioxidant (*9) | — | — | — | — | — | — |
| Antioxidant (*10) | — | — | — | — | — | — |
| Antioxidant (*11) | — | — | — | — | — | — |

Using a color video printer (CVP-G500, produced by Sony Corp.) with thermal sublimation ink ribbons of yellow (Y), magenta (M) and cyan (C) (VPM-P, produced by Sony Corp.), the printing paper 10 samples thus produced were printed to form thereon stair-step images with 12 gradations and solid black images. The light resistance, the dark fading resistance, the sebum resistance, the dye transfer resistance and the plasticizer resistance of the images formed were evaluated by the methods mentioned below. The results obtained are shown in Tables 4 to 7.

(i) Light Resistance:

The images formed on each printing paper 10 sample were exposed to light of 90000 KJ/m$^2$ as a whole over a period of 72 hours at 30° C. and 65% % H, using a xenon fade meter (produced by Suga Tester Co.), whereupon the optical density of the images before and after the exposure was measured with a Macbeth Reflection Densitometer (TR-924). The percentage of dye retention was calculated according to the following equation. The results are shown in Tables 4 and 5.

$$\text{Dye Retention (\%)}=[(\text{optical density after exposure})-(\text{optical density before exposure})]\times 100$$

(ii) Dark Fading Resistance:

The printing paper 10 samples each having images formed thereon were stored in a thermostat (60° C., 85% RH) for 14 days, and the optical density of the images before and after the storage was measured in the same manner as above. The dye retention was obtained also in the same manner as above. The results are shown in Tables 4 and 5.

(iii) Sebum Resistance:

One drop of artificial sebum was applied onto the images formed on the printing paper 10 samples, kept at 35° C. for 10 minutes and then wiped away, whereupon the optical density of the images before and after the wiping of the artificial sebum was measured in the same manner as above. The dye retention was obtained also in the same manner as above. The results are shown in Tables 4 and 5.

(iv) Dye Transfer Resistance:

A sheet of synthetic paper (EPG-150, produced by Oji Petrochemical Co.) was covered over the images formed on each printing paper 10 sample and kept at 60° C. for 48 hours under a load of 40 g/cm$^2$, whereupon the optical density of the synthetic paper before and after the hot pressure test was measured and the difference in the optical density (ΔOD) before and after the test was obtained. The results are shown in Tables 6 and 7.

(v) Plasticizer Resistance:

A polyvinyl chloride sheet containing an ordinary plasticizer was covered over the images formed on each printing paper 10 sample and kept at 50° C. for 24 hours under a load of 40 g/cm$^2$, whereupon the optical density of the synthetic paper before and after the hot pressure test was measured and the difference in the optical density (ΔOD) before and after the test was obtained. The results are shown in Tables 6 and 7.

TABLE 4

| | Light Resistance (dye retention, %) | | | Dark Fading Resistance (dye retention, %) | | | Sebum Resistance' (dye retention, % | | |
|---|---|---|---|---|---|---|---|---|---|
| | Y | M | C | Y | M | C | Y | M | C |
| Example 1 | 85 | 90 | 80 | 92 | 89 | 90 | 92 | 89 | 85 |
| Example 2 | 84 | 88 | 79 | 90 | 85 | 95 | 95 | 92 | 90 |
| Example 3 | 85 | 89 | 85 | 95 | 90 | 90 | 95 | 90 | 92 |
| Example 4 | 87 | 86 | 32 | 91 | 93 | 89 | 90 | 89 | 87 |
| Example 5 | 86 | 92 | 83 | 93 | 90 | 92 | 95 | 92 | 93 |
| Example 6 | 83 | 90 | 80 | 94 | 92 | 90 | 95 | 91 | 92 |
| Example 7 | 85 | 92 | 85 | 95 | 92 | 90 | 93 | 92 | 95 |
| Example 8 | 83 | 90 | 82 | 90 | 92 | 89 | 92 | 91 | 93 |
| Example 9 | 82 | 91 | 80 | 90 | 92 | 93 | 89 | 90 | 93 |
| Example 10 | 85 | 92 | 78 | 90 | 93 | 95 | 93 | 90 | 89 |
| Example 11 | 87 | 91 | 85 | 94 | 89 | 92 | 93 | 89 | 93 |
| Example 12 | 83 | 90 | 82 | 95 | 93 | 89 | 94 | 90 | 90 |
| Example 13 | 82 | 89 | 83 | 94 | 92 | 90 | 92 | 89 | 92 |
| Example 14 | 82 | 90 | 80 | 93 | 90 | 92 | 89 | 91 | 92 |
| Example 15 | 89 | 90 | 79 | 95 | 97 | 95 | 92 | 93 | 90 |
| Example 16 | 92 | 93 | 80 | 95 | 95 | 97 | 90 | 92 | 93 |
| Example 17 | 90 | 91 | 83 | 93 | 90 | 95 | 90 | 89 | 95 |
| Example 18 | 92 | 89 | 85 | 95 | 97 | 90 | 89 | 90 | 93 |
| Example 19 | 93 | 90 | 83 | 92 | 95 | 95 | 90 | 92 | 91 |

TABLE 5

| | Light Resistance (dye retention, %) | | | Dark Fading Resistance (dye retention, %) | | | Sebum Resistance' (dye retention, % | | |
|---|---|---|---|---|---|---|---|---|---|
| | Y | M | C | Y | M | C | Y | M | C |
| Comparative Example 1 | 75 | 81 | 50 | 84 | 80 | 74 | 50 | 45 | 40 |
| Comparative Example 2 | 78 | 80 | 52 | 84 | 80 | 72 | 52 | 40 | 35 |
| Comparative | 80 | 78 | 38 | 88 | 84 | 80 | 60 | 65 | 57 |

TABLE 5-continued

| | Light Resistance (dye retention, %) | | | Dark Fading Resistance (dye retention, %) | | | Sebum Resistance' (dye retention, % | | |
|---|---|---|---|---|---|---|---|---|---|
| | Y | M | C | Y | M | C | Y | M | C |
| Example 3 Comparative Example 4 | 78 | 85 | 56 | 80 | 75 | 70 | 50 | 46 | 42 |
| Comparative Example 5 | 81 | 84 | 57 | 79 | 78 | 71 | 51 | 40 | 37 |
| Comparative Example 6 | 87 | 85 | 42 | 88 | 87 | 85 | 62 | 63 | 60 |

TABLE 6

| | Dye Transfer Resistance (ΔOD) | | | Plasticizer Resistance (ΔOD) | | |
|---|---|---|---|---|---|---|
| | Y | M | C | Y | M | C |
| Example 1 | 0.01 | 0.05 | 0.03 | 0.05 | 0.02 | 0.09 |
| Example 2 | 0.01 | 0.04 | 0.03 | 0.02 | 0.01 | 0.03 |
| Example 3 | 0.01 | 0.04 | 0.03 | 0.03 | 0.01 | 0.02 |
| Example 4 | 0.03 | 0.02 | 0.05 | 0.05 | 0.02 | 0.03 |
| Example 5 | 0.02 | 0.01 | 0.05 | 0.02 | 0.01 | 0.01 |
| Example 6 | 0.03 | 0.02 | 0.03 | 0.02 | 0.01 | 0.01 |
| Example 7 | 0.01 | 0.02 | 0.02 | 0.02 | 0.01 | 0.01 |
| Example 8 | 0.02 | 0.01 | 0.02 | 0.02 | 0.02 | 0.02 |
| Example 9 | 0.03 | 0.02 | 0.03 | 0.05 | 0.02 | 0.03 |
| Example 10 | 0.03 | 0.05 | 0.03 | 0.02 | 0.02 | 0.05 |
| Example 11 | 0.02 | 0.04 | 0.03 | 0.05 | 0.03 | 0.05 |
| Example 12 | 0.03 | 0.03 | 0.02 | 0.02 | 0.02 | 0.03 |
| Example 13 | 0.05 | 0.04 | 0.03 | 0.03 | 0.05 | 0.02 |
| Example 14 | 0.05 | 0.04 | 0.03 | 0.05 | 0.03 | 0.03 |
| Example 15 | 0.03 | 0.04 | 0.05 | 0.04 | 0.03 | 0.04 |
| Example 16 | 0.03 | 0.05 | 0.02 | 0.04 | 0.02 | 0.05 |
| Example 17 | 0.03 | 0.02 | 0.02 | 0.03 | 0.02 | 0.03 |
| Example 18 | 0.05 | 0.02 | 0.03 | 0.03 | 0.02 | 0.03 |
| Example 19 | 0.03 | 0.02 | 0.03 | 0.03 | 0.04 | 0.02 |

TABLE 7

| | Dye Transfer Resistance (ΔOD) | | | Plasticizer Resistance (ΔOD) | | |
|---|---|---|---|---|---|---|
| | Y | M | C | Y | M | C |
| Comparative Example 1 | 0.25 | 0.30 | 0.32 | 0.87 | 0.79 | 0.90 |
| Comparative Example 2 | 0.24 | 0.31 | 0.33 | 0.85 | 0.75 | 0.95 |
| Comparative Example 3 | 0.28 | 0.27 | 0.34 | 0.95 | 0.87 | 0.91 |
| Comparative Example 4 | 0.26 | 0.32 | 0.35 | 0.87 | 0.80 | 0.95 |
| Comparative | 0.28 | 0.38 | 0.40 | 0.85 | 0.80 | 0.90 |

TABLE 7-continued

| | Dye Transfer Resistance (ΔOD) | | | Plasticizer Resistance (ΔOD) | | |
|---|---|---|---|---|---|---|
| | Y | M | C | Y | M | C |
| Example 5 Comparative Example 6 | 0.21 | 0.30 | 0.38 | 0.98 | 0.89 | 0.97 |

From Tables 4 and 5, it is known that the printing paper 10 samples of the present invention, containing a vinylphenolic resin in the dye-receiving layer 30, have higher percentages of dye retention in terms of all the tested items of the light resistance, the dark fading resistance and the sebum resistance and therefore have better image storability than the comparative printing paper 10 samples containing an antioxidant but not a vinylphenolic resin. From Tables 6 and 7, it is known that the amounts of the dyes transferred from the printed paper samples of the present invention onto the synthetic paper or the polyvinyl chloride sheet containing a plasticizer that had been laid on the samples under heat and pressure were extremely small, and therefore it is known that the dye transfer resistance and the plasticizer resistance of the printing paper 10 samples of the present invention are good.

EXAMPLES 20 to 32, Comparative Examples 7 to 12:

A synthetic paper (EPG-150, produced by Oji Petro-Chemical Co.) having a thickness of 150 μm was prepared as a sheet substrate, and this was coated with a coating composition for a dye-receiving layer 30 comprising the components indicated in Tables 8 and 9 below and then cured at 50° C. for 48 hours. Thus, various types of printing paper 10 were produced.

TABLE 8

| | Examples (parts by weight) | | | | | | | | | | | | |
|---|---|---|---|---|---|---|---|---|---|---|---|---|---|
| | 20 | 21 | 22 | 23 | 24 | 25 | 26 | 27 | 28 | 29 | 30 | 31 | 32 |
| Butyral resin (*12) | 100 | 100 | 100 | 100 | 100 | — | — | — | — | — | — | — | — |
| Butyral resin (*13) | — | — | — | — | — | 100 | 100 | 100 | — | — | — | — | — |
| Butyral resin (*14) | — | — | — | — | — | — | — | — | 100 | 100 | 100 | 100 | 100 |
| Vinylphenolic resin (*4) | 5 | — | — | — | — | 5 | 10 | 10 | — | — | — | — | — |
| Vinylphenolic resin (*5) | — | 5 | — | — | — | — | — | — | 5 | — | — | — | — |
| Vinylphenolic resin (*6) | — | — | 5 | — | — | — | — | — | — | 5 | — | — | — |
| Vinylphenolic resin (*7) | — | — | — | 5 | — | — | — | — | — | — | 5 | — | — |
| Vinylphenolic resin (*8) | — | — | — | — | 5 | — | — | — | — | — | — | 5 | 20 |
| Isocyanate compound (*15) | 5 | 5 | 5 | 5 | 5 | 5 | 5 | — | — | — | — | — | — |
| Isocyanate compound (*16) | — | — | — | — | — | — | — | 5 | 5 | 5 | 5 | 5 | 5 |

With regard to Table 8, the following will be noted:
(*12) Butyral resin with a high degree of polymerization (Tg 58° C.; Eslec BH-S produced by Sekisui Co.)
(*13) Butyral resin with a middle degree of polymerization (Tg 57° C.; Eslec BM-S produced by Sekisui Co.)
(*14) Butyral resin with a low degree of polymerization (Tg 54° C.; Eslec BL-S produced by Sekisui Co.)
(*4) P-vinylphenol homopolymer (molecular weight 1600 to 2400; softening point 143° C.; Marukalinker M produced by Maruzen Petrochemical Co.)
(*5) Reduced p-vinylphenol homopolymer (molecular weight 4000 to 6000; softening point 190° C.; Marukalinker PHM-C produced by Maruzen Petrochemical Co.)
(*6) Copolymer of p-vinylphenol and styrene (PVP/ST = about 15/85; molecular weight 7000 to 10000; softening point 120° C.; Marukalinker CST15 produced by Maruzen Petrochemical Co.)
(*7) Copolymer of p-vinylphenol and butyl acrylate (PVP/BA = about 0/70 to 60/40; molecular weight 10000 to 30000; softening point 5° C.; Marukalinker CBA produced by Maruzen Petrochemical Co.)
(*8) Copolymer of p-vinylphenol and methyl methacrylate (pVP/Mm about 1/1; molecular weight 8000 to 12000; softening point 180° C.; Marukalinker CMM produced by Maruzen Petrochemical Co.)
(*15) Non-yellowed XDI (Takenate D-11ON produced by Takeda Chemical Industries, Ltd.)
(*16) Non-yellowed FIDI adduct (Takenate D-16ON produced by Takeda Chemical Industries, Ltd.)

TABLE 9

| | Comparative Examples (parts by weight) | | | | | |
|---|---|---|---|---|---|---|
| | 7 | 8 | 9 | 10 | 11 | 12 |
| Butyral resin (*12) | 100 | 100 | 100 | 100 | — | — |
| Butyral resin (*13) | — | — | — | — | 100 | — |
| Butyral resin (*14) | — | — | — | — | — | 100 |
| Other resin (*17) | — | — | 5 | 10 | 5 | 10 |
| Isocyanate compound (*15) | 5 | — | 5 | 5 | 5 | 5 |
| Isocyanate compound (*16) | — | 5 | — | — | — | — |

With regard to Table 9, the following will be noted:
(*17) Vinyl chloride/vinyl acetate/vinyl alcohol copolymer resin (Eslec A produced by Sekisui Chemical Co.)

Using a standard test printer produced by Machilles Co. with thermal sublimation ink ribbons of yellow (Y), magenta (M) and cyan (C) (UP7000, produced by Sony Corp.) at a pulse width of 5 msec/line, the printing paper 10 samples thus produced were printed to form thereon stair-step images with 12 gradations and solid black images. The light resistance, the dark fading resistance, the sebum resistance, the dye transfer resistance and the plasticizer resistance of the images formed were evaluated by the methods mentioned above. The results obtained are shown in Tables 10 to 13.

From Tables 10 and 11, it is known that the printing paper 10 samples of the present invention, containing a polymer of a vinylphenolic resin, a butyral resin and a poly-functional isocyanate compound in the dye-receiving layer 30, have higher percentages of dye retention in terms of all the tested items of the light resistance, the dark fading resistance and the sebum resistance and therefore have better image storability than the comparative printing paper 10 samples not containing the polymer. From Tables 12 and 13, it is known that the amounts of the dyes transferred from the printed paper samples of the present invention onto the synthetic paper or the polyvinyl chloride sheet containing a plasticizer that had been laid on the samples under heat and pressure were extremely small, and therefore it is known that the dye transfer resistance and the plasticizer resistance of the printing paper 10 samples of the present invention are good.

TABLE 10

| | Light Resistance (dye retention, %) | | | Dark Fading Resistance (dye retention, %) | | | Sebum Resistance' (dye retention, % | | |
|---|---|---|---|---|---|---|---|---|---|
| | Y | M | C | Y | M | C | Y | M | C |
| Example 20 | 85 | 89 | 85 | 95 | 90 | 90 | 92 | 90 | 90 |
| Example 21 | 86 | 92 | 83 | 93 | 90 | 92 | 95 | 93 | 94 |
| Example 22 | 87 | 92 | 85 | 94 | 90 | 93 | 94 | 90 | 95 |
| Example 23 | 92 | 93 | 95 | 95 | 97 | 95 | 95 | 94 | 92 |
| Example 24 | 89 | 91 | 94 | 96 | 95 | 90 | 94 | 92 | 90 |
| Example 25 | 86 | 90 | 92 | 95 | 90 | 90 | 94 | 93 | 93 |
| Example 26 | 87 | 90 | 91 | 94 | 89 | 92 | 95 | 94 | 96 |
| Example 27 | 89 | 93 | 95 | 92 | 90 | 93 | 94 | 93 | 94 |
| Example 28 | 98 | 92 | 87 | 92 | 91 | 90 | 93 | 94 | 90 |
| Example 29 | 90 | 92 | 88 | 91 | 94 | 93 | 94 | 91 | 92 |
| Example 30 | 91 | 93 | 91 | 95 | 94 | 93 | 95 | 92 | 91 |
| Example 31 | 90 | 93 | 95 | 93 | 92 | 93 | 92 | 92 | 91 |
| Example 32 | 92 | 95 | 95 | 94 | 92 | 92 | 95 | 96 | 96 |

TABLE 11

| | Light Resistance (dye retention, %) | | | Dark Fading Resistance (dye retention, %) | | | Sebum Resistance' (dye retention, % | | |
|---|---|---|---|---|---|---|---|---|---|
| | Y | M | C | Y | M | C | Y | M | C |
| Comparative Example 7 | 76 | 75 | 70 | 85 | 84 | 80 | 50 | 45 | 51 |
| Comparative Example 8 | 74 | 77 | 78 | 82 | 80 | 78 | 62 | 44 | 49 |
| Comparative Example 9 | 72 | 76 | 73 | 82 | 81 | 83 | 55 | 53 | 49 |
| Comparative Example 10 | 69 | 75 | 70 | 84 | 83 | 79 | 55 | 50 | 53 |
| Comparative Example 11 | 73 | 75 | 71 | 81 | 79 | 82 | 52 | 50 | 52 |
| Comparative Example 12 | 68 | 75 | 69 | 85 | 84 | 79 | 54 | 49 | 53 |

TABLE 12

| | Dye Transfer Resistance (ΔOD) | | | Plasticizer Resistance (ΔOD) | | |
|---|---|---|---|---|---|---|
| | Y | M | C | Y | M | C |
| Example 20 | 0.02 | 0.01 | 0.03 | 0.01 | 0.04 | 0.03 |
| Example 21 | 0.02 | 0.01 | 0.01 | 0.02 | 0.01 | 0.05 |
| Example 22 | 0.02 | 0.04 | 0.03 | 0.05 | 0.03 | 0.04 |
| Example 23 | 0.05 | 0.02 | 0.01 | 0.03 | 0.05 | 0.02 |
| Example 24 | 0.03 | 0.01 | 0.03 | 0.02 | 0.05 | 0.02 |
| Example 25 | 0.02 | 0.01 | 0.04 | 0.01 | 0.04 | 0.03 |
| Example 26 | 0.02 | 0.01 | 0.02 | 0.01 | 0.02 | 0.02 |
| Example 27 | 0.01 | 0.03 | 0.02 | 0.02 | 0.03 | 0.02 |
| Example 28 | 0.02 | 0.03 | 0.02 | 0.03 | 0.04 | 0.02 |
| Example 29 | 0.02 | 0.03 | 0.02 | 0.04 | 0.04 | 0.02 |
| Example 30 | 0.03 | 0.02 | 0.04 | 0.02 | 0.02 | 0.04 |
| Example 31 | 0.02 | 0.03 | 0.04 | 0.03 | 0.03 | 0.02 |
| Example 32 | 0.01 | 0.01 | 0.02 | 0.01 | 0.01 | 0.02 |

TABLE 13

| | Dye Transfer Resistance (ΔOD) | | | Plasticizer Resistance (ΔOD) | | |
|---|---|---|---|---|---|---|
| | Y | M | C | Y | M | C |
| Comparative Example 7 | 0.25 | 0.35 | 0.39 | 0.87 | 0.75 | 0.95 |
| Comparative Example 8 | 0.24 | 0.35 | 0.40 | 0.75 | 0.69 | 0.87 |
| Comparative Example 9 | 0.26 | 0.34 | 0.39 | 0.69 | 0.72 | 0.85 |
| Comparative Example 10 | 0.26 | 0.35 | 0.41 | 0.65 | 0.72 | 0.81 |

TABLE 13-continued

| | Dye Transfer Resistance (ΔOD) | | | Plasticizer Resistance (ΔOD) | | |
|---|---|---|---|---|---|---|
| | Y | M | C | Y | M | C |
| Comparative Example 11 | 0.27 | 0.33 | 0.42 | 0.71 | 0.69 | 0.84 |
| Comparative Example 12 | 0.25 | 0.33 | 0.39 | 0.64 | 0.72 | 0.79 |

As has been described in detail hereinabove, the printing paper of the present invention can form thereon an image with good storing characteristics in terms of the light resistance, the dark fading resistance, the sebum resistance, the plasticizer resistance, etc.

While the invention has been described in detail and with reference to specific embodiments thereof, it will be apparent to one skilled in the art that various changes and modifications can be made therein without departing from the spirit and scope thereof. All such changes and modifications are fully contemplated by the present invention and appended claims.

What is claimed is:

1. A printing sheet comprising:

a sheet substrate having a surface; and a dye-receiving layer disposed on said surface, said dye-receiving layer being a cross-linked coating obtained by curing a coating composition consisting essentially of:

about 100 parts by weight of a butyral resin;

about 1 to 100 parts by weight, based on 100 parts by weight butyral resin, of a vinylphenolic resin selected from homopolymers and copolymers of m-vinylphenol or p-vinylphenol;

about 1 to 50 parts by weight, based on 100 parts by weight of said butyral resin and said vinylphenolic resin combined, of at least one polyisocyanate compound; and optionally, at least on additive selected from the group consisting of: solvents, plasticizers, whitening agents, pigments, UV absorbers, light stabilizers, antioxidants, surface-improving agents, releasing agents and antistatic agents.

2. A printing sheet as defined in claim 1, wherein the butyral resin has a weight average molecular weight of from about 10,000 to about 500,000 and has a degree of butyralation of 50 mol % or more and a degree of acetylation of 3% or less.

3. A printing sheet as defined in claim 1, wherein the vinylphenolic resin is selected from homopolymers of m-vinylphenol or p-vinylphenol.

4. A printing sheet as defined in claim 1, wherein the polyisocyanate compound is selected from aliphatic polyisocyanates or aromatic polyisocyanates.

* * * * *